United States Patent [19]

Heyer

[11] 4,121,426

[45] Oct. 24, 1978

[54] MINE ROOF SUPPORT UNIT AND ASSEMBLY

[75] Inventor: Willy Heyer, Bochum-Gerthe, Fed. Rep. of Germany

[73] Assignee: Gewerkschaft Eisenhutte Westfalia, Lunen, Fed. Rep. of Germany

[21] Appl. No.: 837,333

[22] Filed: Sep. 28, 1977

[30] Foreign Application Priority Data

Oct. 2, 1976 [DE] Fed. Rep. of Germany ..... 2644649

[51] Int. Cl.[2] ..... E21D 15/44

[52] U.S. Cl. ..... 405/296; 405/299

[58] Field of Search ..... 61/45 D; 299/31-33; 91/170 MP

[56] References Cited

U.S. PATENT DOCUMENTS

| | | | |
|---|---|---|---|
| 3,323,771 | 6/1967 | Dowty | 61/45 D X |
| 3,347,050 | 10/1967 | Dommann et al. | 61/45 D |
| 3,418,814 | 12/1968 | Groetschel | 61/45 D |
| 3,898,845 | 8/1975 | Plevak et al. | 61/45 D |
| 3,928,981 | 12/1975 | Parker et al. | 61/45 D |

FOREIGN PATENT DOCUMENTS

| | | | |
|---|---|---|---|
| 2,453,225 | 5/1976 | Fed. Rep. of Germany | 61/45 D |
| 2,507,319 | 7/1976 | Fed. Rep. of Germany | 61/45 D |
| 2,237,057 | 2/1975 | France | 61/45 D |
| 941,767 | 11/1963 | United Kingdom | 61/45 D |

*Primary Examiner*—Dennis L. Taylor

*Attorney, Agent, or Firm*—Thompson, Birch, Gauthier & Samuels

[57] ABSTRACT

A mine roof support unit comprises a floor sill, a roof cap, a goaf shield and hydraulic props supporting the roof cap above the floor sill. The goaf shield is pivotably connected to both the floor sill and the roof cap. The floor sill is provided with at least one auxiliary prop which is arranged to contact and support the roof cap only when the hydraulic props have been retracted by a predetermined amount.

19 Claims, 1 Drawing Figure

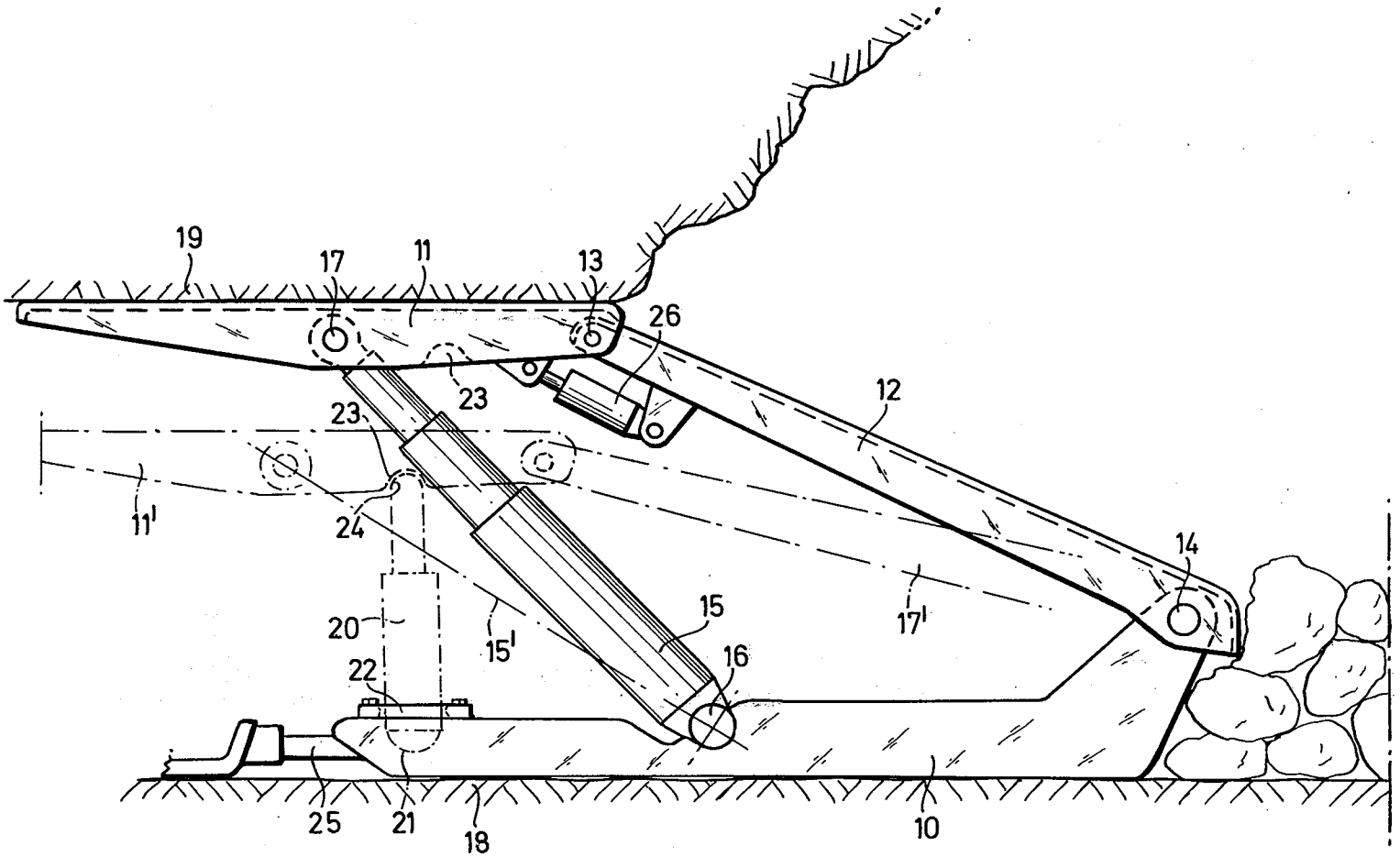
10
11
11'
12
13
14
15
15'
16
17
17'
18
19
20
21
22
23
23
24
25
26

MINE ROOF SUPPORT UNIT AND ASSEMBLY

BACKGROUND TO THE INVENTION

This invention relates to a mine roof support unit, and in particular to a mine roof support unit provided with an articulated goaf shield between a roof cap and a floor sill, at least one telescopic hydraulic prop being provided between the floor sill and the roof cap or between the floor sill and the goaf shield.

Roof support units of various designs are known in which each of the hydraulic props is pivotably mounted at its ends to the sill and the goaf shield or the roof cap. The pivotable mounts are such that each prop can pivot when extended or retracted, in a plane square to that of the floor sill and to that of the worked face. This causes a retracting prop to assume positions increasingly deviating from its desired position square to the floor sill. As a result, the supporting force of the props which is transmitted through the roof cap to the roof is considerably reduced. Where the props are intended to hold up the roof even when highly retracted, they do not always develop a sufficient force to underpin the roof safely.

The drawbacks arising from variable prop inclinations may be counteracted by overrating the props so that even when highly retracted, the roof is still held up with a sufficient force. However, while in the extended condition the supporting force of the props may then be too high and lead to undesirably excessive pressures upon the floor and sometimes on the roof. Moreover, oversize props must be used.

The main object of the invention is to provide a roof support unit which can hold up the roof of an underground working despite varying prop inclinations while highly retracted.

Another object is to provide a roof support unit which develops an adequate support force without oversize hydraulic props, and which may be laid out without transmitting unnecessary or even harmful supporting pressures to the roof while extended.

Yet another object is to provide a roof support unit in which the prop (s) is/are mounted between an overhanging (cantilever) roof cap pointing towards the work face and the floor sill in which the props may be highly inclined in operation.

SUMMARY OF THE INVENTION

The present invention provides a mine roof support unit comprising a floor sill, a roof cap, a goaf shield pivotably connected to both the floor sill and the roof cap, and telescopic hydraulic prop means pivotably mounted on the floor sill for supporing the roof cap, wherein the floor sill is provided with at least one auxiliary prop which is arranged to contact, and provide support for, the roof cap only when said telescopic hydraulic prop means is retracted by a predetermined amount.

Preferably, said telescopic hydraulic prop means is pivotably connected to the roof cap, and two telescopic hydraulic props constitute said telescopic hydraulic prop means.

Advantageously, each auxiliary prop is a telescopic hydraulic prop, and the working stroke of each telescopic hydraulic auxiliary prop is less than that of said telescopic hydraulic prop means.

The shorter auxiliary prop(s) mounted on the floor sill is/are operated only when the roof cap is lowered by retracting the main prop(s) to such an extent that the roof cap comes to rest on the auxiliary prop(s). Then, the roof cap is supported both by the main and auxiliary props and the roof adequately underpinned even when the main prop(s) is/are highly retracted. In thicker coal seams the main props are extended further so that the roof cap is lifted away from the auxiliary prop(s) and supported only by the main prop(s). Since, however, the main props are then inclined to a lesser extent, the roof is still supported with a sufficient holding force.

Preferably, each auxiliary prop is mounted on the floor sill in a respective foot piece. Moreover, each foot piece may be mounted on that side of the pivotable mounting of said telescopic hydraulic prop means that is remote from the pivotable connection of the goaf shield to the floor sill. With this arrangement, each auxiliary prop becomes operative at the instant when the roof cap sinks and assumes a position substantially vertical to the floor sill and so holds the roof with its full rated force, while the main prop(s) becomes inclined between the roof cap and the floor sill and underpins the roof cap in the middle, thereby securing the roof in the area near the worked face.

Advantageously, each auxiliary prop is resiliently mounted substantially vertically in its foot piece. Also, the roof cap may be provided with a respective prop head block for contacting each of the auxiliary props. Preferably, each prop head block is constituted by a socket pivotably mounted in the underneath surface of the roof cap. Each socket may be generally funnel-shaped and widens in the downwards direction, in which case each auxiliary prop is provided with a head complementary to the respective funnel-shaped socket.

Since each auxiliary prop operates only when the main props are retracted in narrow seams by said predetermined amount, it is advisable for each auxiliary prop to be removably mounted in its foot pieces. When the seam thickness is great the auxiliary prop(s) may be removed altogether from that foot piece(s) on the floor sill. Then, when in the course of mining, the seam becomes thinner the auxiliary prop(s) may be quickly inserted into its/their foot piece(s) thereby increasing the roof holding capacity of the whole roof support unit.

BRIEF DESCRIPTION OF THE DRAWING

A roof support unit constructed in accordance with the invention will now be described, by way of example, with reference to the accompanying drawing, the single FIGURE of which is a side elevation of the unit.

Referring to the drawing, the roof support unit consists of a floor skid or sill 10 comprising one or more sections, a roof cap 11 and a goaf shield 12 pivotably connected by a joint 13 with the rear (goaf) end of the roof cap, and by a joint 14 at the rear end of the floor sill. Between the floor sill 10 and the roof cap 11 at least one hydraulic telescopic prop 15 is mounted with unrestricted articulation. 16 denotes the prop foot joint on the floor sill 10, and 17 denotes the prop head joint on the roof cap 11. Each of the joints 16 and 17 is preferably a ball joint. It is also recommended to provide the roof support unit with at least two hydraulic props 15 spaced longitudinally along the longwall face.

As can be seen from the drawing, the props 15, when extended and retracted, change their inclination with respect to the floor 18 and the roof 19 of the mine working in such a manner that the angle of inclination to the horizontal is smaller the more the props are retracted and inclined.

To develop an adequate holding force when the props 15 are retracted, at least one additional auxiliary support prop 20 (shown in the chain dotted lines) is provided whose length, both in the extended and retracted positions is materially smaller than the length of the main hydraulic props 15. It is sound practice to provide the roof support unit with two auxiliary props 20 which are spaced in the longitudinal direction of the longwall face. Each auxiliary prop rests in a foot piece 21 mounted adjacent to the front end of the floor sill 10 and at a distance from the foot joints 16 of the props 15. Preferably, a respective articulated socket constitutes each of the foot pieces. Each of the foot pieces 21 is provided with a support 22 for keeping its auxiliary prop 20 in that foot piece in an upright position when that prop is not in contact with roof cap 11. The foot pieces 21 and supports 22 are intended to hold the auxiliary props 20 elastically and pivotably in their foot pieces and to enable them to perform within limits, pivoting movements. The cap 11 is provided in its underneath face with a prop head block 23 for each auxiliary prop 20 each prop head block consisting of a funnel shaped articulated pan widening downwards. The extending part of the hydraulic auxiliary props are each provided with a matching ball head 24. The prop head blocks 23 are positioned between the head joints 17 and the joint 13 for the goaf shield 12.

When the roof support unit is used with thick coal seams, the hydraulic props 15 are extended and the roof cap 11 is held against the roof 19 by the props 15, the roof cap being lifted out of contact with the auxiliary props 20. The props 15 are designed to support the roof 19 with the necessary force when the unit is used with such seams. Since in this case the auxiliary props 20 are out of action, they may be lifted out of their foot pieces 21 and removed altogether.

When the seam is narrower, the hydraulic props (shown in chain-dotted lines at 15') are retracted and hence are more inclined to the vertical. The prop heads 24 of the short auxiliary props 20 enter the open head blocks 23 on the roof cap 11 when this is lowered. The engagement of the prop heads 24 of the auxiliary props 20 in their blocks 23 is faciliated by the funnel shaped widening of the head blocks and the elastic mounting of the auxiliary props. As soon as the roof cap 11 comes to rest on the heads 24 of the props 20, the latter begin to carry roof loads to their full capacity. The roof cap 11 is then supported both by the inclined main props 15 and by the auxiliary props 20 which are positioned substantially vertically. When the auxiliary props 20 are actuated, the roof holding force (up to then developed only by the main props 15) is suddenly increased which prevents any subsidence of the roof 19.

The shorter stroke of the props 20 and the longer strokes of the props 15 are preferably correlated so that, when the props 15 are fully retracted, the props 20 are also fully retracted. Alternatively, when the props 15 are fully retracted, the props 20 may be arranged so as to be nearly completely retracted.

Advance of the roof support unit is effected, as usual, by an advance ram 25 connected to the floor sill 10 of the unit. Its abutment during advance is a longwall conveyor (not shown). Between the roof cap 11 and the goaf shield 12, a hydraulic ram 26 may be provided for forcing the roof cap against the roof 19 at its rear end. In practice a plurality of like units are positioned side-by-side along the work face, the units being advanced individually or in groups in a snake-like movement.

I claim:

1. A mine roof support unit comprising a floor sill, a roof cap, a goaf shield pivotably connected to both the floor sill and the roof cap, and telescopic hydraulic prop means pivotably mounted on the floor sill for supporting the roof cap, wherein the floor sill is provided with at least one auxiliary prop whose length, both in the extended and retracted positions, is smaller than the length of said telescopic hydraulic prop means, said auxiliary prop being arranged to contact, and provide support for, the roof cap only when said telescopic hydraulic prop means is retracted by a predetermined amount.

2. A mine roof support unit according to claim 1, wherein said telescopic hydraulic prop means is pivotably connected to the roof cap.

3. A mine roof support unit according to claim 1, wherein two telescopic hydraulic props constitute said telescopic hydraulic prop means.

4. A mine roof support unit according to claim 1, wherein each auxiliary prop is a telescopic hydraulic prop.

5. A mine roof support unit according to claim 4, wherein the working stroke of each telescopic hydraulic auxiliary prop is less than that of said telescopic hydraulic prop means.

6. A mine roof support unit according to claim 1, wherein each auxiliary prop is mounted on the floor sill in a respective foot piece.

7. A mine roof support unit according to claim 6, wherein each foot piece is mounted on that side of the pivotable mounting of said telescopic hydraulic prop means that is remote from the pivotable connection of the goaf shield to the floor sill.

8. A mine roof support unit according to claim 6, wherein each auxiliary prop is resiliently mounted substantially vertically in its foot piece.

9. A mine roof support unit according to claim 1, wherein the roof cap is provided with a respective prop head block for contacting each of the auxiliary props.

10. A mine roof support unit according to claim 9, wherein each prop head block is constituted by a socket pivotably mounted in the underneath surface of the roof cap.

11. A mine roof support unit according to claim 10, wherein each socket is generally funnel-shaped and widens in the downwards direction.

12. A mine roof support unit according to claim 11, wherein each auxiliary prop is provided with a head complementary to the respective funnel-shaped socket.

13. A mine roof support unit according to claim 9, wherein each head block is mounted on the roof cap between the pivotable connection of the goaf shield to the roof cap and the pivotable connection of said telescopic hydraulic prop means to the roof cap.

14. A mine roof support unit according to claim 6, wherein said auxiliary prop is removably mounted in its foot piece.

15. A mine roof support unit according to claim 3, wherein each auxiliary prop has a smaller cross-section than each prop constituting said telescopic hydraulic prop means.

16. In a mine roof support unit comprising a floor sill, a roof cap, a goaf shield pivotably connected to both the floor sill and the roof cap, and telescopic hydraulic prop means pivotably mounted on the floor sill for supporting the floor cap, the improvement comprising at least one auxiliary prop mounted on the floor sill, said at least one auxiliary prop having a length, both in the extended and retracted positions, which is materially smaller than that of said telescopic hydraulic prop means, said at least one auxiliary prop being arranged to contact and support the roof cap only when said telescopic hydraulic prop means is retracted by a predetermined amount.

17. A mine roof support unit comprising a floor sill, a roof cap, a goaf shield pivotably connected to both the floor sill and the roof cap, a pair of main telescopic hydraulic props pivotably mounted between the floor sill and the roof cap, and a pair of auxiliary telescopic hydraulic props pivotably mounted on the floor sill and arranged to contact and support the roof cap only when the main props are retracted by a predetermined amount, wherein the length, both in the extended and retracted positions, of each auxiliary prop is less than that of each of the main props.

18. A mine roof support assembly comprising a plurality of mine roof support units arranged side-by-side, each of the units comprising a floor sill, a roof cap, a goaf shield pivotably connected to both the floor sill and the roof cap, and telescopic hydraulic prop means pivotably mounted on the floor sill for supporting the roof cap, wherein the floor sill is provided with at least one auxiliary prop which has a length materially smaller than that of said telescopic hydraulic prop means and which is arranged to contact, and provide support for, the roof cap only when said telescopic hydraulic prop means is retracted by a predetermined amount.

19. A mine roof support assembly according to claim 8, wherein each unit is provided with advance ram means for advancing that unit towards a mine force to be worked.

* * * * *